US007052555B1

(12) United States Patent
Reed

(10) Patent No.: US 7,052,555 B1
(45) Date of Patent: May 30, 2006

(54) METHOD OF REMOVING SURFACE COATINGS

(76) Inventor: William C. Reed, 5753 Whistlewood Cir., Sarasota, FL (US) 34232

( * ) Notice: Subject to any disclaimer, the term of this patent is extended or adjusted under 35 U.S.C. 154(b) by 140 days.

(21) Appl. No.: 10/919,725

(22) Filed: Aug. 17, 2004

Related U.S. Application Data

(63) Continuation of application No. 09/802,308, filed on Mar. 8, 2001, now Pat. No. 6,776,920.

(51) Int. Cl.
*B08B 3/00* (2006.01)
*B08B 7/00* (2006.01)
*C23D 17/00* (2006.01)

(52) U.S. Cl. ..... 134/34; 134/32; 134/33; 134/38; 134/39; 134/40; 134/25.1; 134/10; 134/4

(58) Field of Classification Search ..... None
See application file for complete search history.

(56) References Cited

U.S. PATENT DOCUMENTS 4,368,134 A * 1/1983 Kaeser ..... 510/532
5,415,900 A * 5/1995 Reed ..... 427/547
5,537,363 A * 7/1996 Holcomb ..... 366/273
5,573,817 A * 11/1996 Reed ..... 427/561
5,599,531 A * 2/1997 Holcomb ..... 424/70.1
5,658,573 A * 8/1997 Holcomb ..... 424/400
5,804,068 A * 9/1998 Reed ..... 210/222
6,607,648 B1 * 8/2003 Franceschetti et al. ..... 204/557
6,776,920 B1 * 8/2004 Reed ..... 252/8.05

* cited by examiner

*Primary Examiner*—Joseph D. Anthony
(74) *Attorney, Agent, or Firm*—William Nitkin

(57) ABSTRACT

A gel is produced by magnetically treating and mixing two solutions and in one embodiment subsequently introducing carbon dioxide gas. The first solution is comprised of water and sodium bicarbonate, and the second solution is comprised of water and sodium silicate. The first solution is passed through a positively charged magnetic field, and the second solution is passed through a negatively charged magnetic field. The two solutions are then mixed together to form a gel. The resulting gel has excellent fire-fighting capabilities because of its high heat absorption and emissive qualities. Also disclosed is a method for using the gel to aid in the removal of surface coatings.

2 Claims, 1 Drawing Sheet

METHOD OF REMOVING SURFACE COATINGS

This application is a continuation of my previous application entitled Heat-absorbing Gel Material filed Mar. 8, 2001, Ser. No. 09/802,308 now U.S. Pat. No. 6,776,920.

BACKGROUND OF THE INVENTION

1. Field of the Invention

The present invention relates to a magnetically treated water-based solution of sodium silicate and sodium bicarbonate formed in a gel and its method of production and delivery as an aid to removing surface coatings and as a fire-fighting aid.

2. Description of the Prior Art

U.S. Pat. No. 5,415,900 to Reed discloses a method of delivering a substance into a material mass. This invention is specifically directed to the rearrangement of fluid molecules from an agglomerated state to a more linear and organized state. As a result of this linear molecular organization produced by a magnetic influence, the fluid's permeability into a material mass is greatly enhanced, and penetration of the fluid through the surface and periphery of the material mass occurs much more readily than if the fluid's molecular organization had remained in an agglomerated state. The magnetic influence utilized in this invention not only makes the fluid more permeable by effecting a linear organization of its molecules, which is a critical feature of the invention, but also serves to facilitate the assimilation of such fluids throughout the interior of the material mass. This is accomplished by polarizing two fluids to opposite charges with magnetic fields of different polarities. As a result, the naturally attractive forces between the oppositely charged fluids increases the rate of absorption of the second fluid to be introduced into the material mass and ensures that the absorption of this second fluid is directed throughout the interior of the material mass.

An additional advantage of the fluid polarization effected by a magnetic influence is that the positive polarity of the fluid molecules will be increased, thereby increasing the spaces between the individual fluid molecules through greater repellency. As a result of this increased polarity, the fluid molecules are separated to a greater extent so that the molecules are able to penetrate individually rather than collectively into a given material mass, thereby significantly enhancing the permeability of the fluid. In addition, because fluid molecules which are positively charged by a magnetic influence become more separated, chemically reactive agents that are added to the fluids, which serve as carrier vehicles, attain a more uniform distribution amongst the fluid molecules. After the carrier fluids and chemically reactive agents therein are introduced into the material mass, the more uniform dispersion of the chemical agents in the carrier fluids results in an acceleration of the normal reaction time of such chemically reactive agents within the interior of the material mass.

U.S. Pat. No. 5,804,068 to Reed discloses a magnetic fluid treatment device. The object of this invention is to provide a device that can effectively polarize a fluid contained therein in order to gradually rearrange its fluid molecules into a more linear, organized and substantially more permeable state.

SUMMARY OF THE INVENTION

The present invention uses polarized fluids for the purpose of producing gels. The present invention discloses how the mixture of varying ratios of water to sodium silicate and water to sodium bicarbonate can create a gel with beneficial uses including a gel with heat suppression and emissive characteristics and a gel capable of aiding in safely removing surface coatings, such as paint or other surface sealers.

The present invention is directed towards a magnetically treated sodium silicate and sodium bicarbonate gel and a method for its delivery. Initially, for example, a first solution is created by mixing 55 gallons of water with 50 lbs of sodium bicarbonate and passing the resulting mixture through a magnetic device of positive polarity, such as the device taught in U.S. Pat. No. 5,804,068, to create a positively charged solution. A second solution is made by mixing 11 gallons of sodium silicate with 44 gallons of water and passing the resulting mixture through a magnetic device of negative polarity, such as the device taught in U.S. Pat. No. 5,804,068, to create a negatively charged solution. In order to produce a gel material, the positively charged first solution is mixed in a static mixer with the negatively charged second solution in equal amounts to create a gel. While these two mixtures will ultimately form a gel when mixed together in an uncharged state, by magnetically activating the two solutions, the resulting gel has more uniform heat and emissive properties and is more highly structured to provide for more uniform assimilation.

The present invention also discloses a gaseous production methodology by introducing gaseous carbon dioxide into a mixture of the first and second magnetically treated solutions which action instantaneously converts the newly formed liquid mixture or semi-soliquid mixture into a gel. Thus it is an object of the present invention to provide a heat-absorbing gel to be used in fighting fires. Due to the unique structure of the gel mixture, high levels of carbon dioxide gas are absorbed therein and the gas further acts as a catalyst in the formation of the heat-absorbing gel of this invention.

Another object of the present invention is to provide a method of delivering a fire-fighting gel into a fire. The system improves upon virtually all existing fire-fighting systems. The system feeds both the first positively charged solution and the second negatively charged solution into a static mixer connected to a pressure pump. The mixture is pressurized to approximately 5000 psi and pumped into a hand-held or turret-mounted dispersion device. The dispersion device can be a zero degree pressure tip that rotates 360 degrees continuously, propelled by the 5000 psi pressure pump. The high level of carbon dioxide present in most fire conditions mixes with the sprayed mixture and instantaneously renders the sprayed liquid mixture into a gel.

A further object of the present invention is to provide a gel and method of use to aid in the removal of surface coatings. A typical cutting device is used in conjunction with the gel which acts as a lubricant. The gel material further encapsulates the coating or concrete particles being removed, while extending the life of the cutting device 300%–500% over current cutting device life spans. The cohesive quality of the gel imparts the ability to contain the materials being removed. The used gel material can be collected, and the particulate and paint separated therefrom.

The Occupational Health and Safety Agency ("OSHA") and the Environmental Protection Agency ("EPA") monitor the application, use, containment, and disposal of solvents and other chemical means used in the removal of surface coatings. Many existing systems have detrimental side effects in their application both to the user and to the environment. Mechanical systems of coating removal, such as high pressure washing and scarification, produce dust and odor, and also require containment. Since many environments are enclosed, and most chemical processes require a high-level air exchange, there is a need for a safe and efficient method of coating removal. The present invention lubricates and contains the removed coating material particles, which action eliminates large amounts of dust and airborne coating material. Thus the coating removal method of this invention serves to meet the safety requirements of the law.

BRIEF DESCRIPTION OF THE DRAWING

The FIGURE illustrates a diagrammatic view of the production of one embodiment of the gel of this invention.

DESCRIPTION OF THE PREFERRED EMBODIMENT(S)

Figure 1:
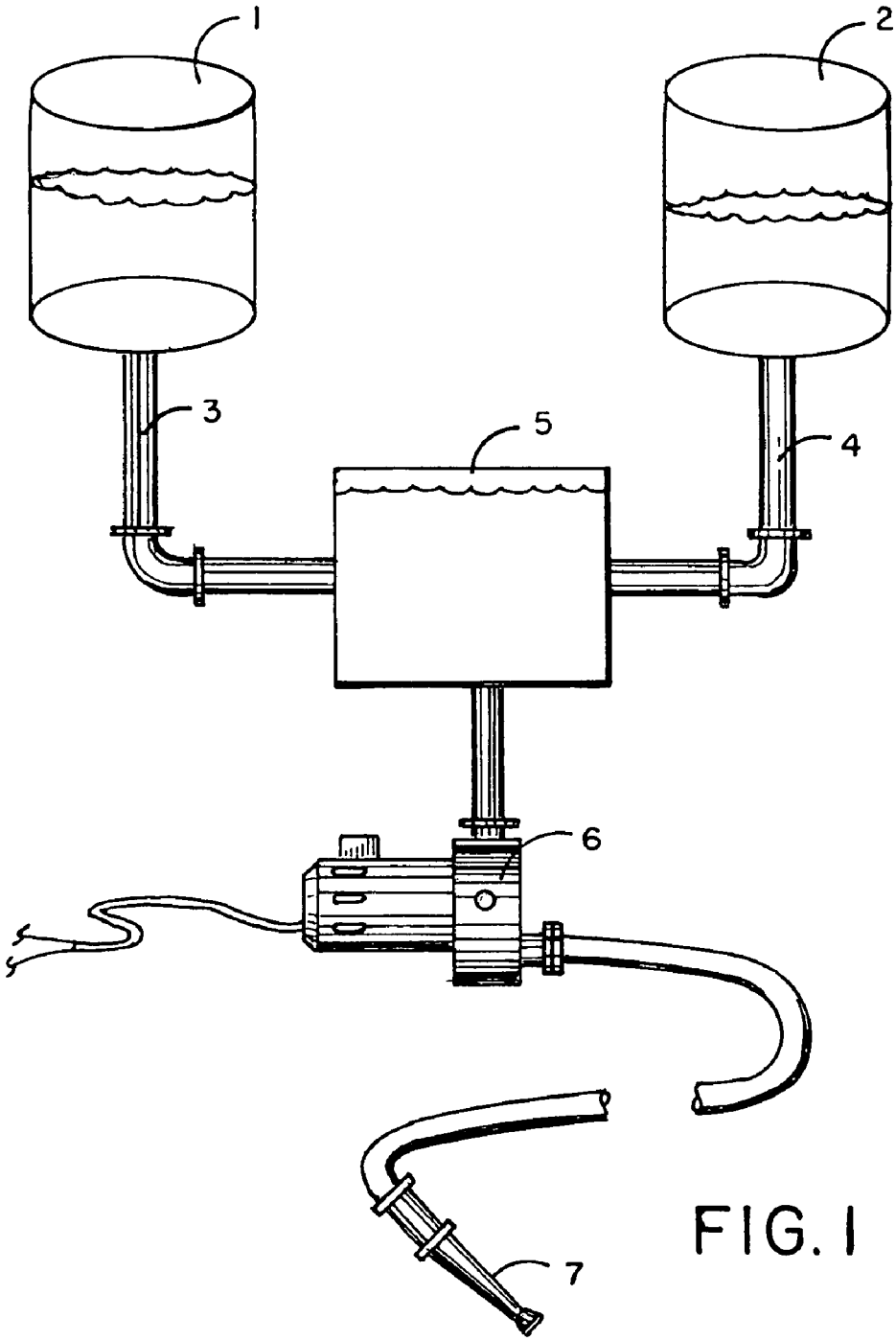

In one example as discussed above, the first solution can be created by mixing 55 gallons of water with 50 lbs. of sodium bicarbonate and passing such mixture through a magnetic device of positive polarity (See U.S. Pat. No. 5,804,068 to Reed). A second solution can be made by mixing 11 gallons. of sodium silicate with 44 gallons of water and passing the mixture through a negatively charged magnetic field. The two solutions are then mixed together in equal amounts. The resulting mixture sets over time to form a gel. By magnetically activating the two solutions of the mixture, the mixture has uniform heat absorption and emissive properties. The mixture can also be instantaneously converted to a gel state by the introduction of carbon dioxide gas. To dissolve and remove the gel, when desired, water can be either sprayed onto, or added to, the mixture. The gel then liquefies immediately and is nontoxic. In some embodiments a surfactant or soap can be added to the gel which addition converts the gel to a foam structure which foam also has fire-fighting properties.

When the gel is applied to burning embers, the gel smothers the fire and eliminates any re-ignition of the fire. There are numerous uses for such a gel material such as, for example, a structural fire suppression material, a forest fire suppression material, for foam fire suppression applications and as a fuel fire suppression material when mixed with imbiber beads. The gel can be used for the purpose of forest fire line development and used in clothing as a gel liner having advanced heat absorption capacity, retention or retardation; and in gel suits for fire protection. The gel can also be used in advanced firewall construction, backpack spraying equipment, and pourable liquid heat sinks. The gel can also be utilized by air application through the use of aircraft; and for air and marine craft fire suppression purposes.

One method for delivery of the gel in fire-fighting situations is best understood by reference to the FIGURE. Seen therein are first and second reservoirs 1 and 2 which are filled, respectively, with the first positively charged solution and the second negatively charged solution. The first and second solutions are gravity fed through their respective first and second channels 3 and 4 into a static mixer 5 connected to pressure pump 6. The pressurized mixture is dispersed through a zero degree pressure tip 7 that rotates at 360 degrees continuously. As the mixture is expelled from tip 7, the gel material is atomized into thousands of micro droplets. The droplets' transition from a liquid state to a gel state is quickened by the presence of carbon dioxide found in most fire conditions.

When shot into burning infernos, the gel material of this invention provides a firecutting system that can literally slice through all types of fire situations. This system will also use less than 10% of the amount of water typically required to extinguish a fire of the same magnitude. When drought conditions prevail, the occurrence of forest fires is an ever present danger. In situations where the availability of water is limited, the use of the system of this invention will conserve water in the fighting and prevention of fires.

The following examples will illustrate the specific embodiments of the present invention's fire-fighting capabilities:

EXAMPLE 1

The gel material, when placed in a ¼-inch deep 2-inch diameter circle cut into a 12-inch block of expanded polystyrene, withstood temperatures used to cut through steel and protected the polystyrene immediately thereunder while the unprotected perimeter of the block melted.

EXAMPLE 2

A cedar shake panel was constructed and placed in a test chamber. The panel was coated with the gel of this invention and placed under conditions that are used to test fire retardant materials in a Class A fire rating. The panel withstood the fire, wind and temperature extremes, passing the Class A Spread of Flame test.

The gel material of this invention can also be used in the removal of surface coatings by grinding by lubricating the grinder's cutters, and then containing any particles removed in a safe and totally user-friendly and environmentally safe manner. For example, the gel material of this invention can be used with virtually any existing floor coating removal device. Normally the surface material being removed by the cutting and grinding process would generate large amounts of harmful particulate matter. The gel of this invention, however, surrounds the coating or concrete particles being removed. The gel material surrounding the surface coating and cutting device particles can then be collected into a sieve and rinsed with water, causing the gel to liquefy and run off. Because the diluted and liquefied gel is nontoxic, it can be safely disposed of. The gel also extends the life of the cutting device 300%–500% through its lubricating properties. The properties exhibited by the gel are due to its heat absorptive and emissive qualities. Since the gel is water-based, the gel provides a level of heat reduction that is equivalent to that of continuously running water. Moreover, the gel's properties allow the cutters to work more effectively as the gel also provides a lubricated cutting surface.

Although the present invention has been described with reference to particular embodiments, it will be apparent to those skilled in the art that variations and modifications can be substituted therefor without departing from the principles and spirit of the invention.

I claim:

1. A method for the removal of a coating from a surface, comprising the steps of:

providing a first solution made by mixing water with sodium bicarbonate;

providing a second solution made by mixing water with sodium silicate;

passing said first solution through a positively charged magnetic field;

passing said second solution through a negatively charged magnetic field;

mixing equal parts of said first solution and said second solution together to form a mixture;

allowing said mixture to stand and set, thereby forming a gel;

introducing said gel onto said surface coating to be removed;

providing a surface grinder;

lubricating said surface grinder by said presence of said gel on said surface coating;

grinding said coating on said surface into particles to remove said surface coating;

absorbing heat by said gel produced by said grinding step; and surrounding said ground surface material particles with said gel.

2. The method of claim 1 further including the steps of:

collecting said ground surface material particles covered by said gel; and rinsing said collected ground surface material particles with water to liquefy said gel and cause it to run off; and recovering said particles for proper disposal.

* * * * *